United States Patent [19]

Bustos

[11] 4,064,995

[45] Dec. 27, 1977

[54] DISPLAY RACK

[76] Inventor: Rafael T. Bustos, 1629 Folkstone Road, N.D., Atlanta, Ga. 30329

[21] Appl. No.: 658,351

[22] Filed: Feb. 17, 1976

[51] Int. Cl.[2] ..... A47F 5/10

[52] U.S. Cl. ..... 211/187; 52/288; 108/111; 211/208

[58] Field of Search ..... 211/187, 190, 207, 208, 211/148, 186, 189, 191; 108/107, 111; 312/257 R, 257 SK; 52/729, 758 H, 288, 312, 716; 248/345.1

[56] References Cited

U.S. PATENT DOCUMENTS

| | | | |
|---|---|---|---|
| 2,909,289 | 10/1959 | Laurie | 108/107 X |
| 3,306,466 | 2/1967 | Liston | 108/107 |
| 3,393,031 | 7/1968 | Morrill | 312/257 R X |
| 3,712,003 | 1/1973 | Hallock et al. | 52/288 X |
| 3,717,968 | 2/1973 | Olsen et al. | 52/288 |
| 3,742,668 | 7/1973 | Oliver | 52/288 |
| 3,862,691 | 1/1975 | Mori et al. | 211/191 |
| 3,901,611 | 8/1975 | Simonsen | 211/191 X |
| 3,937,133 | 2/1976 | Bertin et al. | 312/257 R X |

FOREIGN PATENT DOCUMENTS

| | | | |
|---|---|---|---|
| 1,041,037 | 9/1966 | United Kingdom | 108/107 |

*Primary Examiner*—Roy D. Frazier
*Assistant Examiner*—Robert W. Gibson, Jr.

[57] ABSTRACT

A display rack having a novel corner post and shelf support structure. In preferred form, the corner post is of an angular, non-tubular configuration, and includes a plurality of shelf locater hole pairs provided along the length of the post. The shelf support clip is adapted to seat on the inside surface of the corner post, the clip including a pair of fingers that extend through a cooperating pair of the holes in the post at the desired shelf level. A decor strip is slidably received in a guideway defined on the external surface of the corner post, thereby hiding the clip's fingers and the unused locater holes from sight when the corner post's external surface is viewed by an observer.

4 Claims, 5 Drawing Figures

DISPLAY RACK

This invention relates to display racks. More particularly, this invention relates to display racks of the type having multiple shelves of adjustable height.

Adjustable shelf display racks are often used in supermarkets, as well as other types of stores, to display items of merchandise generally handled as self-service items. For example, such a display rack is often used to display cases or cartons of soft drink bottles in supermarkets, the bottles being removable by the customer in a self-service manner from the display rack. One of the most important features of such display racks, in present day merchandising practice, is the attractiveness or appearance of the rack. It is necessary that the display rack be of a neat and attractive appearance so as to not offend the customer from an aesthetic standpoint. Further, it is also important that the display rack provide an adjustable shelf structure which has no objectionable sharp corners or protrusions or the like which might provide injury, e.g., scrapes or nicks, to the customer. Of course, it is also important that the display rack have shelves that are easily adjusted upward or downward relative to floor level by non-skilled labor already in the employ of the store, the position of the shelves depending on the merchandise being marketed from the display rack.

Display racks with adjustable height shelves are well known to the prior art. There are numerous different structural embodiments of such display racks. One commonly used type of display rack makes use of corner posts having a tubular configuration. The tubular corner posts are provided with holes along the length thereof to permit mounting of shelves, the holes being adapted to receive locater tangs or fingers associated with the shelves, thereby supporting the shelves at the desired vertical position. While a tubular corner post structure insures that each shelf's locater tangs or fingers will be held in protective enclosure (since the tangs protrude into the interior of the tubular corner posts), this is a more expensive corner post structure than is, for example, a right angle corner post structure. Further, such tubular corner posts must, to enhance the aesthetics of the display rack, generally be of a costly tubular material, such as burnished chrome.

Therefore, it has been one objective of this invention to provide a display rack having an angular, i.e., non-tubular, corner post structure that is provided with a removable decor insert.

It has been a further objective of this invention to provide a display rack wherein each corner post structure is of an angular, and preferably a right angular, cross-sectional configuration, shelf locater fingers interconnecting with holes in the post structure to retain the shelf in fixed vertical position, and wherein a decor strip is connectable with the corner post for enclosng that finger and locater hole structure from sight when the corner post's external surface is viewed by an observer.

In accord with these objectives, the preferred display rack structure of this invention includes a corner post of an angular, non-tubular configuration, and includes a plurality of shelf locater hole pairs provided along the length of the post. A shelf support clip is adapted to seat on the inside surface of the corner post, the clip including a pair of fingers that extend through a cooperating pair of the holes in the post at the desired shelf level. A decor strip is slidably received in a guideway defined on the external surface of the corner post, thereby hiding the clip's fingers and the unused locater holes from sight when the corner post's external surface is viewed by an observer. The shelf includes an edge wall depending from a support surface, that edge wall being trapped between the clip and the internal surface of the post to restrain the shelf in seated relation on the clip, thereby locating the shelf at the desired vertical position on the display rack.

Other objectives and advantages of this invention will be more apparent from the following detailed description taken in conjunction with the drawings in which.

Figure 1:
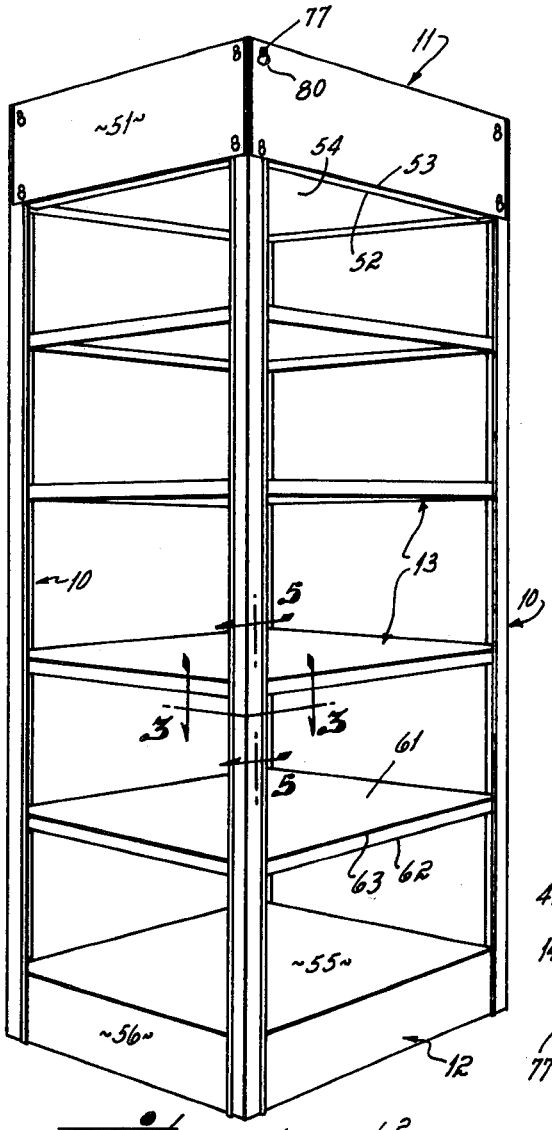
FIG. 1 is a perspective view illustrating an erected display rack in accord with the principles of this invention.
Figure 2:
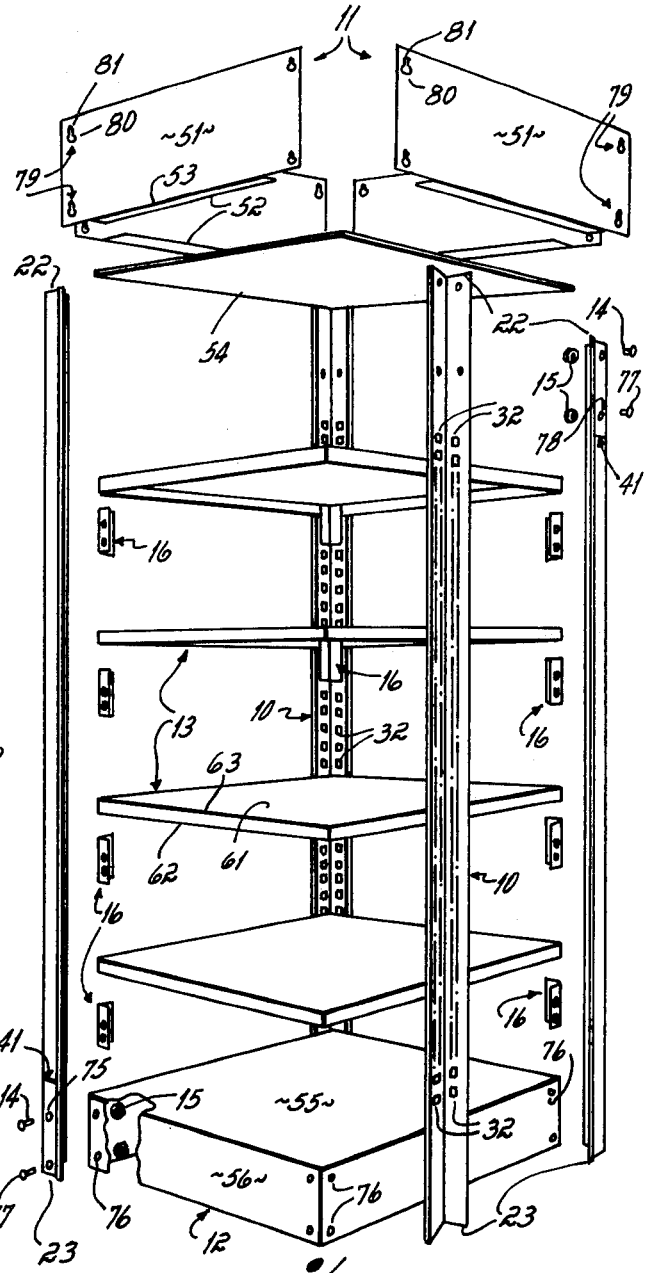
FIG. 2 is a view similar to FIG. 1 but showing the display rack in a disassembled position.

As illustrated in FIG. 1, the display rack of this invention includes four corner posts 10, a head frame 11, a base frame 12, and four shelves 13, all of which are connected together to form a rigid display rack unit. The head frame 11 and the base frame 12 are connected to the four corner posts 10 by bolts 14 and nuts 15. The shelves 13 are connected with the four corner posts by shelf support clips 16, the shelf support clips being selectively positionable on the corner posts along the length thereof, thereby permitting the height of the shelves to be adjusted as desired relative to the floor on which the display rack rests.

Figure 3:
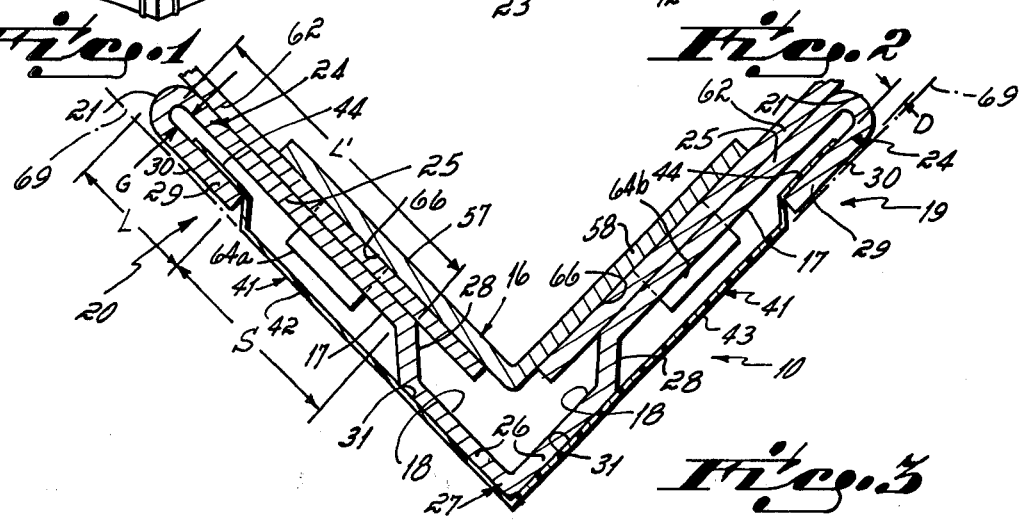
FIG. 3 is a cross-sectional view of a corner post taken along line 3—3 of FIG. 1.
Figure 4:
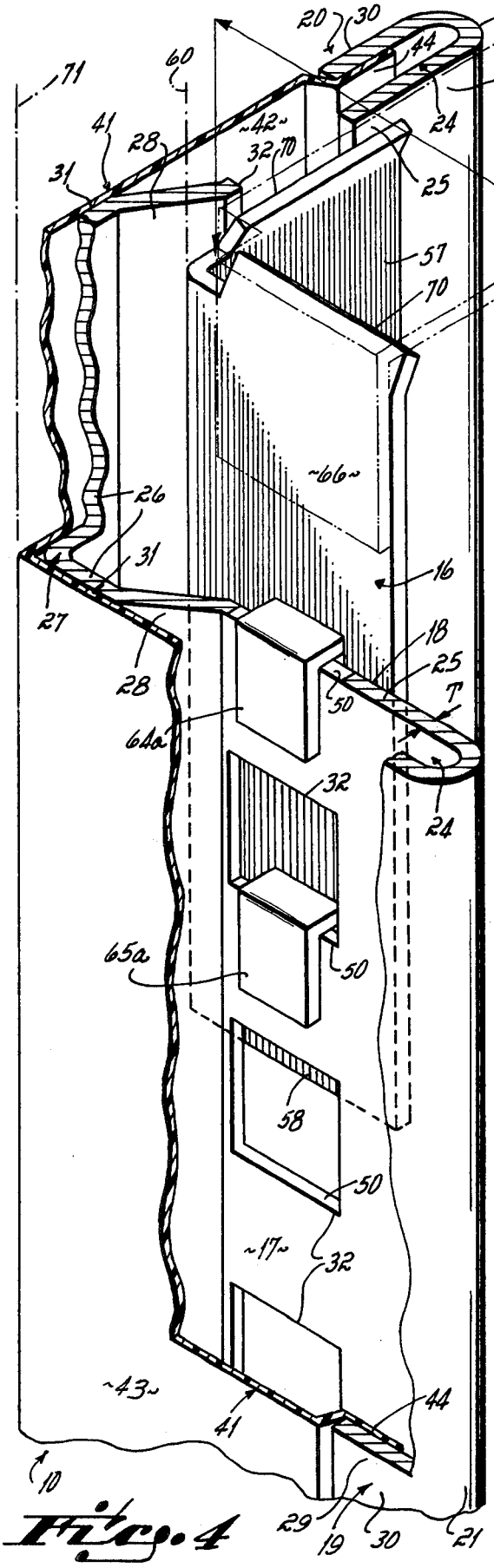
FIG. 4 is a blown-up broken away perspective view illustrating a section of a corner post and a shelf clip in connected combination.

As shown in FIGS. 3 and 4, each corner post 10 is comprised of a generally right angular member having an external surface 17 and an internal surface 18, and has a right hand side wall 19 and a left hand side wall 20 as viewed from the external surface. Edge 21 of each side wall 19 or 20 of the right angular post 10, from the top 22 to the bottom 23 thereof, is provided with a decor strip connector structure in the form of an outwardly turned lip 24. The U-shaped lips 24 along each edge of the corner post 10 cooperate to define a right angle shaped guideway that extends longitudinally of the corner post. As particularly illustrated in FIG. 3, the outwardly turned lip 24 on the outer edge of each side wall 19, 20 includes an inner lip portion 25 offset inwardly from the adjacent wall 26 of the post's corner rib 27, the inner lip portion being connected therewith through web 28. Outer lip portion 29 of the U-shaped lip member 24 is parallel to the inner lip 25, and is spaced from the inner lip 25 so as to define a gap G therebetween but also so that the external surface 30 thereof is substantially coplanar with the external surface 31 of the adjacent corner rib wall 26. The corner rib walls 26, 26 cooperate to define the corner rib 26, 26 of the corner post 10. Further, and importantly as will appear below, the outer lip portion 29 is of substantially shorter length L than the length L' of the inner lip portion 25, thereby exposing the external face 17 of section S of the side wall 19 or 20 to an observer. The inwardly offset section S of the corner post 10 (which does not overlie the outer lip 24), on each side 19, 20 thereof, is provided with a series of spaced holes 32 along the post's length. The holes 32 in sides 19, 20 are paired, and are adapted to receive the shelf support clips 16 in seated relation therewith on finger seat edges 50 as is described in detail below. The corner posts 10 may be fabricated of extruded aluminum, or otherwise from a material of substantial strength.

A decor strip 41, adapted to connect with each corner post 10 is illustrated in detail in FIGS. 3 and 4. The decor strip 41 is receivable or engageable with the guideway defined by U-shaped lips 24 along the corner post's edges, the strip being longitudinally slidable or receivable into connected engagement with the corner post. The decor strip 41 also is in the general configuration of a right angle member. Each side wall 42, 43 of the decor strip 41 terminates in a foot 44 offset from the general plane 69 of that side wall a distance D about equal to the thickness of the metal from which the corner post 10 is fabricated. The width of the decor strip's side walls 42, 43 are sized so that, when the side walls overlie or are mated with the external faces 31 of the corner post's rib 27, feet 44 are received in U-shaped or outwardly turned lips 24 of the corner posts, thereby retaining the decor strip in fixed relation with the corner post 10, see particularly FIG. 3. Since the offset distance D of each foot 44 from its respective side wall 42, 43 of the decor strip is about equal to the thickness of the metal used to fabricate the corner post 10, substantial parallelism of each side wall section 42, 43 of the decor strip 41 is maintained relative to the adjacent side wall section 25, 26 of the corner post 10 when the two are interconnected. The decor strip may be fabricated of a colored vinyl, or chrome, or the like.

The corner post 10 structures are secured together at the top 22 and bottom 23 by the head frame 11 and the floor frame 12, respectively. The head frame 11 is in the nature of four vertical panels 51, each having an inwardly turned lip 52 along the bottom edge 53 thereof. Each panel 51 is adapted to be secured between paired right 19 and left 20 side walls of opposed corner posts 10 on the external faces 17 thereof by suitable nuts 15 and bolts 14. When the vertical head panels 51 have been located in place, the inwardly turned lower lips 52 of the head panels define a frame upon which head plate 54 may be seated, thereby defining a ceiling for the display rack. The floor frame 12 includes a floor 55 having downwardly depending side walls 56 of substantial depth. The floor 55, 56 structure is sized to fit flush against the internal faces 18 of the corner posts' side walls 19, 20 when the display rack is assembled. The floor 55, 56 structure is held in fixed relation with the corner posts by two pairs of bolts 14 and nuts 15 at each corner connecting the post with the side walls 56.

Figure 5:
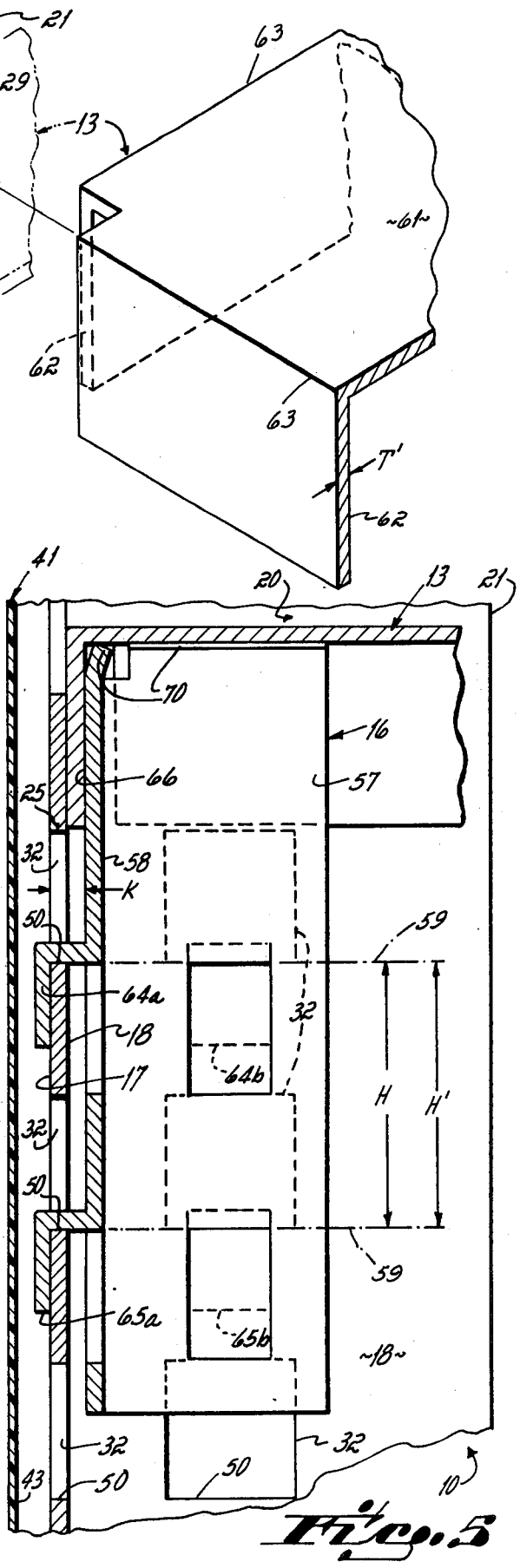
FIG. 5 is a cross-sectional view taken along line 5—5 of FIG. 1.

Each shelf 13 is fabricated of a single metal sheet having a generally planar shelf portion 61, and downwardly turned edge 62 portions on each of the four edges 63 of the shelf. It is the edge portions 62 which, in combination with the planar shelf portion 61, interrelate with shelf support clips 16 to hold the shelf 13 in the desired vertical position relative to the corner posts 10 and, hence, relative to floor level, see FIGS. 4 and 5. A typical shelf support clip 16 for use with the display rack of this invention is of the same general angular cross section geometry as the corner post 10, i.e., is of a generally right angular structure. The shelf support clip 16 includes two pairs of fingers **64*a*, 64*b*, and 65*a*, 65*b* protruding outwardly and downwardly from the external faces 66 of the clip's side walls 57, 58. Each pair 64, 65 of fingers is located in a phantom plane 59 transverse to the longitudinal axis 60 of the clip 16 (which axis 60 is parallel to the longitudinal axis 71 of the corner post 10 when the clip and post are assembled), and each pair of fingers 64, 65 is spaced one from the other along the clip's axis 60 a distance H which is the same as the distance H′ between the finger seat edges 50 of successive square holes 32 in the corner post 10. Note that the fingers 64, 65 are spaced outwardly from the external surface 66 of the angle member clip 16 a distance K slightly greater than the thickness T of the metal from which the corner post 10 is formed, and about equal to the combined post thickness T and thickness T′ of the metal sheet from which each shelf 13 is fabricated. Such permits insertion of the edge wall portions 62 of each shelf 13 into the gap established between the internal surface 18 of the corner post's leg section 25 and the external surface 66 of the shelf support clips 16 when the post 10 and clips 16 are assembled, the shelf portion 61 resting on top edges 70 of the clips, thereby supporting the shelf in the desired height position relative to the floor. Note that the top edges 70 of each shelf clip 16 are slightly flared inwardly; such facilitates insertion or engagement of the shelf 13 in seated relation with the clips 16 once the clips are mounted on the posts 10. Although the clips 16 have been shown with two pairs 64, 65** of fingers per clip, it will be understood that the shelf support clips may be fabricated with only one pair of fingers as well.

In use, and to assemble the display rack of this invention, the decor strips 41 may first be removed from the corner posts 10. As a first step, each of the four corner posts 10 is connected at a respective corner of the floor frame 12 by bolts 14 and nuts 15, holes 75 being provided at the foot of each corner post 10 on each side wall 19, 20 of the corner post to mate with respective holes 76 provided in the floor frame's side walls 56. Such corner post holes 75 are located within that section S of side walls 19, 20 between the offset portion 28 and outer leg 30 of foot 24 in each side wall 19, 20. Such a hole 75 location permits the decor strip 41 to cover the bolt's heads 77 when the bolts are installed through the corner post 10 during erection of the display rack.

As a second step, the shelves 13 themselves may be positioned on now vertical corner posts 10, shelf support clips 16 being interconnected with each of the four corner posts at the desired level of the shelves relative to ground level. As previously noted, the shelf support clips 16 are seated on the internal surface 18 of the angle corner posts 10 with fingers 64, 65 of the clips extending through square locater holes 32 in the corner posts and depending downwardly over the corner post's exterior surface so as to seat or locate the shelf clips in fixed position with each corner post, see particularly in FIGS. 3 and 4. Note that the locater holes 32 for shelf clips 16 are also formed in section S of the post's side walls 19, 20, that section being spaced rearwardly from front surface plane 30, 31 of each of the post's side walls (which plane 30, 31 defines the right angle configuration of the post 10). In this seated attitude of each shelf support clip 16, and because of the extension length K of the fingers 64, 65 from the external face 66 of the clip, a gap is defined between the external face of each clip and the internal face 18 of the post's section S. This gap permits a shelf's depending edge walls 62 to fit between the support clip 16 and the post 10, and permits the shelf portion 61 to sit on top edge 70 of the clip, thereby firmly seating and trapping the shelf 13 in fixed height location on the display rack. After all shelves have been so positioned, the decor strips 41 are then slidably received in the guideway defined by the two outwardly turned feet 24 that run along the outside edges of each corner post 10, the strips thereby covering the clips' fingers 64, 65 extending onto the external face 17 of the corner post, as well as the floor frame's bolt heads 77 as previously mentioned.

Thereafter, the head frame 11 of the display rack may be installed. Such installation is accomplished by first connecting the bolts 14 and the nuts 15 in suitable holes 78 provided at the top 22 of the corner posts 10 without tightening same, i.e., leaving gaps between the surface plane 30, 31 of the corner post and the bolt heads 77. Each head frame wall or partition 51 is provided with corresponding bolt holes 79 having a lower portion 80 of diameter larger than that of bolt heads 77 and an upper portion 81 of diameter smaller than that of the bolt heads, thereby permitting each panel to be hung on a pair of bolts 77 provided on each side wall 19 and 20 of each corner post. Once the head panels 51 are hung in position, the ceiling panel 54 is then simply placed in operational position and is so held by the head panel's inwardly turned lips 52. The head frame's bolts 14 are then tightened so that the display rack cornerposts are fixedly related at both the top, as well as at the bottom, of the rack.

Having described in detail the preferred embodiment of my invention, what I desire to claim and protect by Letters Patent is:

1. A display rack comprising at least one shelf, a corner post of a generally angular configuration, said corner post including a corner rib positioned at the angular corner of said corner post, a decor strip connector structure laterally spaced from said corner rib and extending along each longitudinal edge of said corner post, a side wall section connected between said corner rib and each decor strip connector structure with at least one of said side wall sections being set back inwardly from a planar external face that includes an exterior surface of said corner rib, and a plurality of shelf locater holes provided along the length of said post in said setback wall section for establishing a plurality of potential shelf support levels along the length of said post for said shelf, at least one shelf support clip mounted on the internal face of said corner post, said clip including at least one finger adapted to extend through one of said shelf locater holes to establish said clip at the desired shelf support level, and each shelf being located and supported by a clip relative to the ends of said post, and a decor strip mounted in said decor strip connector structure on the external surface of said corner post, said decor strip being structured to permit removal of said decor strip from operable combination with said corner post, said corner rib and each of said decor strip connector structures cooperating with said decor strip to define a substantially planar external face for each external face of said post, and said decor strip being structured to overlie said clip's finger for preventing inadvertent contact therewith and for hiding unused shelf locater holes from sight when the corner post's external faces are viewed by an observer.

2. A display rack as set forth in claim 1 said decor strip connector structure including an outwardly turned lip along each longitudinal edge of said corner post, said lips being adapted to cooperate with said decor strip for retaining said decor strip in operable combination with the corner post.

3. A display rack as set forth in claim 2, said decor strip being of a generally angular configuration having side walls, and said decor strip including an offset foot extending along each side wall's longitudinal edge of said decor strip, the offset distance of said foot from the plane of each decor strip side wall being approximately equal to the thickness of the material from which said corner post is fabricated.

4. A display rack as set forth in claim 1, said shelf support clip including at least one pair of fingers, said fingers being provided in a plane substantially transverse to the longitudinal axis of said clip, and a plurality of pairs of locater holes on said corner post with one hole of each pair being provided in one of said corner post's side wall sections, and the other hole of each pair being provided in the other of said corner post's side wall sections, said pairs of locater holes being positioned along the length of said corner post, and said pairs of locater holes being positioned in planes substantially transverse to the longitudinal axis of said corner post.

* * * * *

UNITED STATES PATENT AND TRADEMARK OFFICE

CERTIFICATE OF CORRECTION

PATENT NO. : 4,064,995

DATED : December 27, 1977

INVENTOR(S) : Rafael T. Bustos

It is certified that error appears in the above-identified patent and that said Letters Patent are hereby corrected as shown below:

On page 1 please enter the assignee of this patent as -- Leggett & Platt, Incorporated, Carthage, Missouri --

Signed and Sealed this

Sixteenth Day of May 1978

[SEAL]

Attest:

RUTH C. MASON
Attesting Officer

LUTRELLE F. PARKER
Acting Commissioner of Patents and Trademarks